US005906689A

United States Patent [19]

Sircar

[11] Patent Number: 5,906,689

[45] Date of Patent: May 25, 1999

[54] CORROSION RESISTANT ALUMINUM ALLOY

[75] Inventor: Subhasish Sircar, Richmond, Va.

[73] Assignee: Reynolds Metals Company, Richmond, Va.

[21] Appl. No.: 08/659,787

[22] Filed: Jun. 6, 1996

[51] Int. Cl.[6] ..... C22C 21/00

[52] U.S. Cl. ..... 148/439; 148/440; 420/532; 420/535; 420/544

[58] Field of Search ..... 420/540, 541, 420/544, 532, 535, 553; 148/439, 440, 550

[56] References Cited

U.S. PATENT DOCUMENTS

| | | | |
|---|---|---|---|
| 3,878,871 | 4/1975 | Anthony et al. | 420/541 |
| 5,125,452 | 6/1992 | Yamauchi et al. . | |
| 5,286,316 | 2/1994 | Wade . | |

OTHER PUBLICATIONS

Mechanism of Intergranular Corrosion of AL–Cu Alloys, J. R. Galvele and S. M. De De Micheli, Paper presented at the 4th International Congress on Metallic Corrosion, Amsterdam, Sep. 7–14, 1969, pp. 795–807.

Pitting Potential of High Purity Binary Aluminum Alloys—1, Al–Cu Alloys, Pitting and Intergranular Corrosion, I. L. Muller and J. R. Galvele, Corrosion Science, 1977, vol. 17, pp. 179 to 193.

Designing of an Optimum Aluminum Aloy for De–Salination Applications, Z. Ahmed, Strength of Metals and Alloys, Proceedings of the 6th International Conference, Melbourne, Australia, Aug. 16–20 1982, pp. 255–261.

*Primary Examiner*—George Wyszomierski
*Assistant Examiner*—M. Alexandra Elve
*Attorney, Agent, or Firm*—Alan M. Biddison

[57] ABSTRACT

An aluminum-based alloy composition having improved corrosion resistance and extrudability consists essentially of, in weight percent, an amount of copper up to about 0.03%, between about 0.1 and 0.5% manganese, between about 0.03 and 0.30% titanium, between about 0.06 and 1.0% zinc, an amount of iron up to about 0.50%, between about 0.05 and 0.12% Si, less than 0.01% manganese, less than 0.01% nickel, up to 0.5% chromium with the balance aluminum and incidental impurities. A process of making an aluminum alloy article having high corrosion resistance also is provided.

9 Claims, 3 Drawing Sheets

* 3102 - 0.06 Si, 0.51 Fe, 0.024 Cu, 0.35 Mn, <0.01 Mg, <0.01 Cr, <0.01Ni, 0.02 Zn, 0.03 Ti, 3102A Balance Al

CORROSION RESISTANT ALUMINUM ALLOY

FIELD OF THE INVENTION

The present invention is directed to a corrosion resistant aluminum alloy and, in particular, to an AA3000 series type aluminum alloy including controlled amounts of copper, zinc and titanium.

BACKGROUND ART

In the prior art, aluminum is well recognized for its corrosion resistance. AA1000 series aluminum alloys are often selected where corrosion resistance is needed.

In applications were higher strengths may be needed, AA1000 series alloys have been replaced with more highly alloyed materials such as the AA3000 series type aluminum alloys. AA3102 is one example of a higher strength aluminum alloy having good corrosion resistance.

Aluminum alloys of the AA3000 series type have found extensive use in the automotive industry due to their combination of high strength, light weight, corrosion resistance and extrudability. These alloys are often made into tubing for use in heat exchanger or air conditioning condenser applications.

One of the problems that AA3000 series alloys have when subjected to corrosive environments is pitting or blistering corrosion. These types of corrosion often occur in the types of environments found in heat exchanger or air conditioning condenser applications and can result in failure of an automotive component where the corrosion compromises the integrity of the aluminum alloy tubing.

In a search for aluminum alloys having improved corrosion resistance, more highly alloyed materials have been developed such as those disclosed in U.S. Pat. Nos. 4,649,087 and 4,828,794. These more highly alloyed materials while providing improved corrosion performance are not conducive to extrusion due to the need for extremely high extrusion forces.

U.S. Pat. No. 5,286,316 discloses an aluminum alloy with both high extrudability and high corrosion resistance. This alloy consists essentially of at least 0.1–0.5% by weight of manganese, about 0.05–0.12% by weight of silicon, about 0.10–0.20% by weight of titanium, about 0.15–0.25% by weight of iron with the balance aluminum. This alloy is essentially copper free with the level of copper not exceeding 0.03% by weight.

Although the alloy disclosed in U.S. Pat. No. 5,286,316 offers improved corrosion resistance over AA3102, even more improved corrosion resistance is desirable. In corrosion testing using salt water-acetic acid sprays as set forth in ASTM Standard G85 (hereinafter SWAAT testing), condenser tubes made of AA3102 material lasted only eight days in a SWAAT test environment before failing. In similar experiments using the alloy taught in U.S. Pat. No. 5,286,316, longer durations than AA3102 were achieved. However, the improved alloy of U.S. Pat. No. 5,286,316 still failed in SWAAT testing in less than 20 days. During this testing, it was discovered that lowering the copper content to impurity levels provided better corrosion resistance than alloy compositions having copper amounts greater than this value. However, maintaining such a low copper content in the aluminum alloy tube to be cast is difficult under industrial casting conditions. Thus, it is impractical to produce an aluminum alloy with such a low copper content in spite of its improved corrosion resistance.

Accordingly, a need has developed to provide an aluminum alloy offering better corrosion resistance, particularly pitting or blistering corrosion resistance, than that provided by AA3102 and the alloy composition disclosed in U.S. Pat. No. 5,286,316. In response to this need, the present invention provides an aluminum alloy material which is more user friendly during manufacture by having practical limitations on the amount of copper while providing improved corrosion resistance over prior art alloys.

SUMMARY OF THE INVENTION

Accordingly, it is a first object of the present invention to provide an aluminum alloy having improved corrosion resistance, in particularly pitting and blistering corrosion resistance.

Another object of the present invention is to provide an aluminum alloy which includes manageable levels of copper to facilitate manufacturing.

A still further object of the present invention is to provide an aluminum alloy which has both hot formability and corrosion resistance.

Another object of the present invention is to provide an extrusion, particularly, extruded condenser tubing, having improved corrosion resistance and good hot formability.

Other objects and advantages of the present invention will become apparent as a description thereof proceeds.

In satisfaction of the foregoing objects and advantages, the present invention provides a corrosion resistant aluminum alloy consisting essentially of, in weight percent, an amount of copper up to 0.03%, between about 0.1 and about 0.5% manganese, between about 0.03 and about 0.30% titanium, less than 0.01% magnesium, less than 0.01% nickel, between about 0.06 and about 1.0% zinc, an amount of iron up to about 0.50%, up to 0.20% chromium with the balance aluminum and inevitable impurities.

More preferably, the copper is about 0.008% or less, the titanium is between about 0.12 and 0.20%, the zinc is between about 0.10 and 0.20% and iron is between about 0.05 and 0.30%.

The inventive corrosion resistant aluminum alloy provides improved corrosion resistance over known AA3000 series type alloys. Further, no deterioration is seen with respect to hot deformation as a result of the zinc content. Consequently, the inventive aluminum alloy exhibits both good corrosion resistance and hot formability.

BRIEF DESCRIPTION OF THE DRAWINGS

Reference is now made to the drawings of the invention wherein.

DESCRIPTION OF THE PREFERRED EMBODIMENTS

Figure 1A:
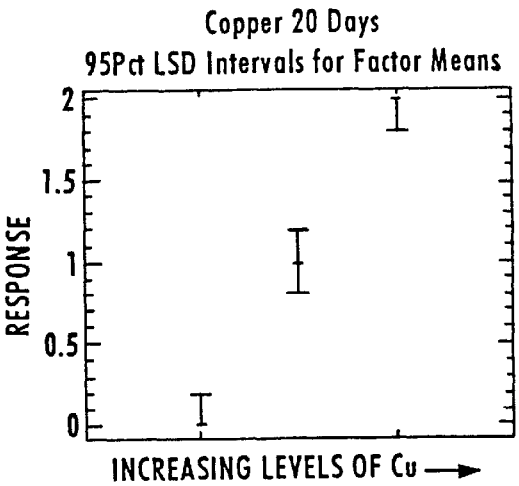
FIGS. 1*a*–1*c* are statistical analysis graphs relating levels of copper to failures in SWAAT testing over time.

The present invention provides an aluminum alloy having significantly improved corrosion resistance over the prior art alloys. As set forth above, the AA3000 series type alloys are prone to pitting corrosion and blistering, particularly in environments wherein the alloys are manufactured into condenser tubing for heat exchanger or air conditioning applications. The inventive alloy composition, through control of the alloying elements thereof, provides vastly improved corrosion resistance properties.

In its broadest sense, the inventive corrosion resistant aluminum alloy consists essentially of, in weight percent, an amount of copper up to 0.03%, between about 0.1 and about 0.5% manganese, between about 0.03 and about 0.30% titanium, between about 0.06 and about 1.0% zinc, less than about 0.01% magnesium, less than 0.01% nickel, an amount of iron up to about 0.50%, an amount of Si between about 0.05 and 0.12%, up to 0.5% chromium with the balance aluminum and inevitable impurities.

Preferably, the copper content is held to less than about 0.01%. The titanium percent is preferably maintained between about 0.07 and 0.20%, more preferably between about 0.12 and about 0.15%. The zinc amount is maintained between about 0.05 and 1.0%. The iron content is maintained between about 0.05 and 0.30%.

More preferably, the zinc content is maintained between about 0.06 and 0.5%. The chromium content is controlled to about 0.20% or less.

To demonstrate the improved corrosion resistance of the inventive aluminum alloy composition, a series of alloy compositions, see Table 1, were selected with varying amounts of copper, titanium, chromium, and zinc alloying elements. For instance, titanium levels varied between 0.06%, 0.09%, 0.12%, 0.15% and 0.19%. Chromium levels varied between zero, 0.005%, 0.05% and 0.10%. The zinc targets included 0.03%, 0.10%, and 0.20%.

The manganese target for alloys A–K, M and N was 0.26% and the silicon target for these same alloys was 0.06%. The iron target was 0.2% for alloys A and B, 0.12% for alloys C–E, 0.1% for alloys F–K, M and N. The nickel and magnesium contents were targeted to be less than 0.01%.

In alloys C–E, the chromium content measured less than 0.5%.

In an effort to demonstrate the improvements associated with the inventive aluminum-based alloy over known prior art alloys, corrosion resistance testing was performed according to ASTM G85 standards. In this testing, condenser tubing is manufactured and subjected to a corrosion resistance testing procedure using a cyclical salt-water acetic acid spray test, hereinafter referred to as SWAAT testing. In this testing, specimens of each condenser tubing are cut to six or twelve inch lengths and exposed to the hostile environment mentioned above for times up to 40 days. After a specified exposure interval, the specimens are cleaned in an acid solution to remove the corrosion products and pressurized using 10 psi gas followed by immersing the specimens in water. A visual observation is made as to whether the tubing has been corroded to a degree such that gas bubbles leak through the tubing. A visual observation of this nature is designated as a failure, (F). If the tubing is not corroded such that gas bubbles pass therethrough, the tubing passes and is given a (P) designation.

The condenser tubes for the SWAAT testing are 6 mm diameter with a wall thickness of 0.41 mm. The alloyed compositions to be tested were cast into extrusion billets of 8 inch diameter, the billets were homogenized and extruded using conventional processing conditions. These conditions are further detailed in U.S. Pat. No. 5,286,316 to Wade, herein incorporated by reference. It should be noted that the condenser tubing used for the corrosion test is the enhanced type which has corrugations on the tubing interior surface.

The extruded tubing was then subjected to a series of SWAAT tests for determination of pass-fail results and corrosion resistance. Tables 2 and 3 are charts comparing the SWAAT test results for both long tubes and short tubes of the alloying compositions in Table 1. The pass-fail results are shown for intervals of 10, 20, 30 and 40 days. Table 2 also compares an AA3102 type alloy to the alloy compositions listed in Table 1.

Tables 2 and 3 indicate which aluminum alloy compositions are preferred for corrosion resistance. For example, alloy I3 having high levels of copper and chromium failed to provide 20 days of corrosion resistance. In contrast, alloys M, N, C3 and H2 provided outstanding corrosion resistance even up to 40 days under SWAAT testing.

To further demonstrate the effects of the various alloying additions on corrosion resistance, additional SWAAT testing was done in sufficient quantity to permit an analysis of variance calculation to be performed to generate graphs showing the effects of alloying elements on corrosion resistance. These graphs compare the varying levels of specific alloying elements with a response indicative of corrosion resistance. The lower the response value, the better the corrosion resistance.

Figure 1B:
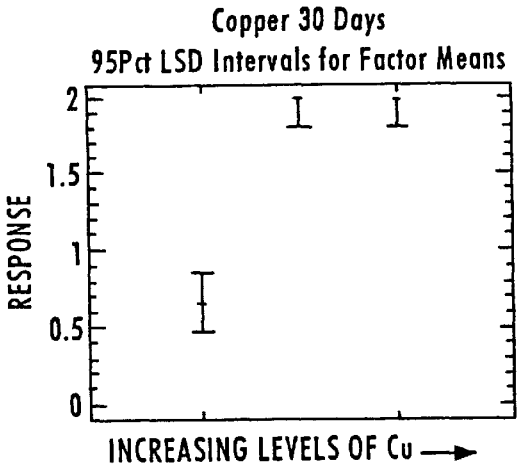
Figure 1C:
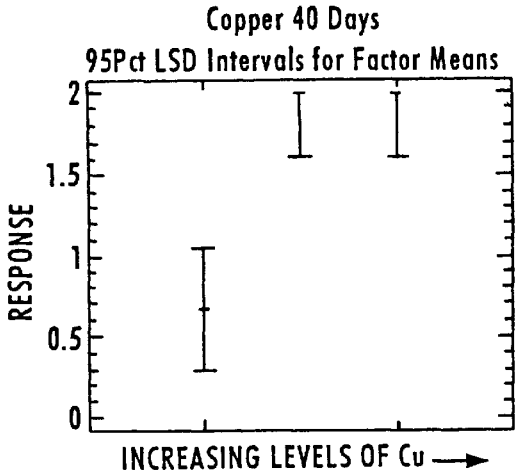

Referring to FIGS. 1*a*–1*c*, the graphs clearly show that low decreasing levels of copper provide improved corrosion resistance.

Figure 2A:
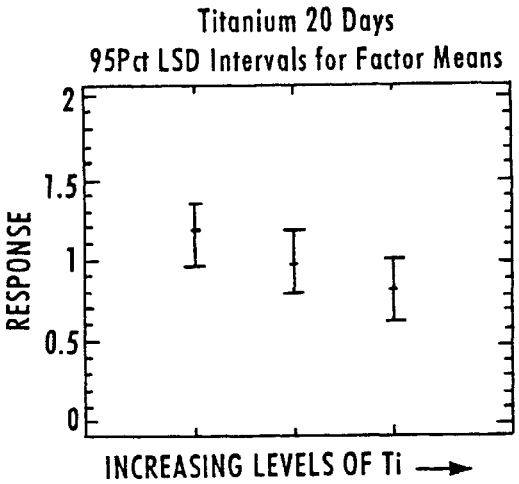
FIGS. 2*a*–2*c* are statistical analysis graphs relating levels of titanium to failures in SWAAT testing over time.
Figure 2B:
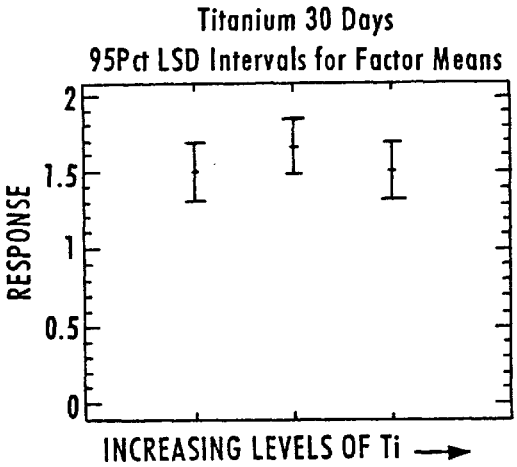
Figure 2C:
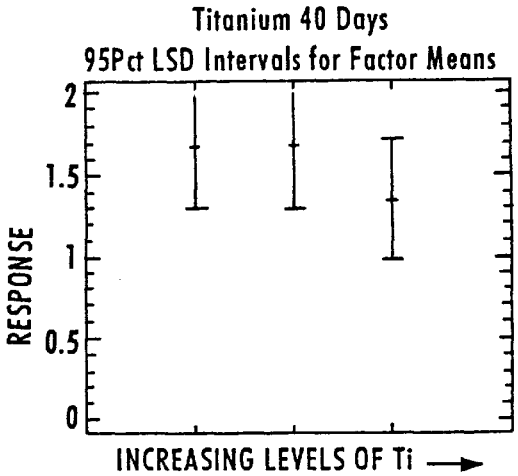

FIGS. 2*a*–2*c* indicate that increasing levels of titanium contribute to corrosion resistance.

Figure 3A:
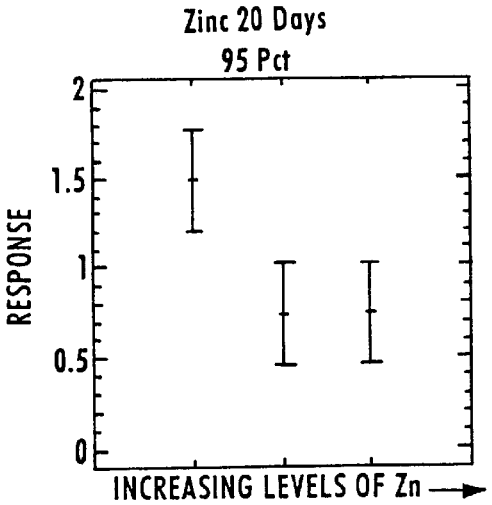
FIGS. 3*a*–3*c* are statistical analysis graphs relating levels of zinc to failures in SWAAT testing over time.
Figure 3B:
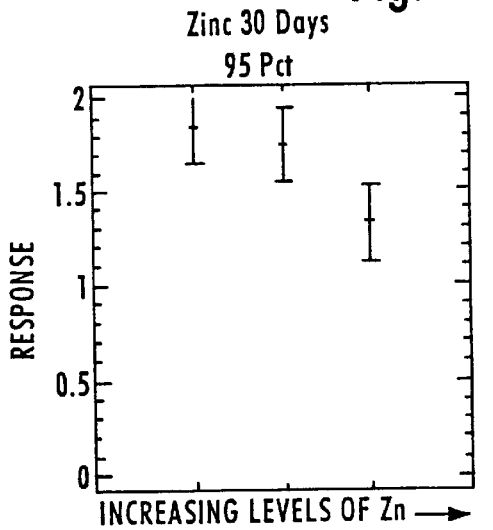
Figure 3C:
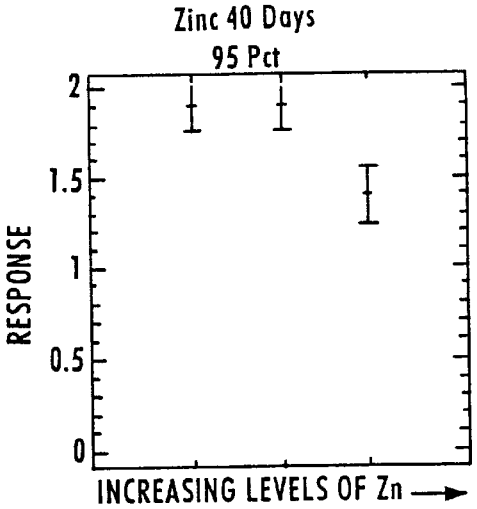

FIGS. 3*a*–3*c* show that improved corrosion resistance is obtained when using increasing levels of zinc.

Figure 4A:
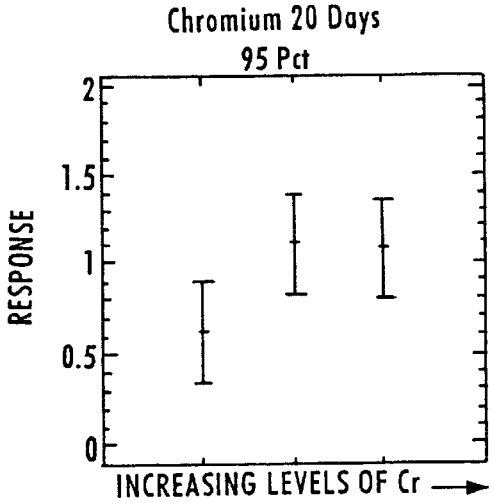
FIGS. 4*a*–4*c* are statistical analysis graphs relating levels of chromium to failures in SWAAT testing over time.
Figure 4B:
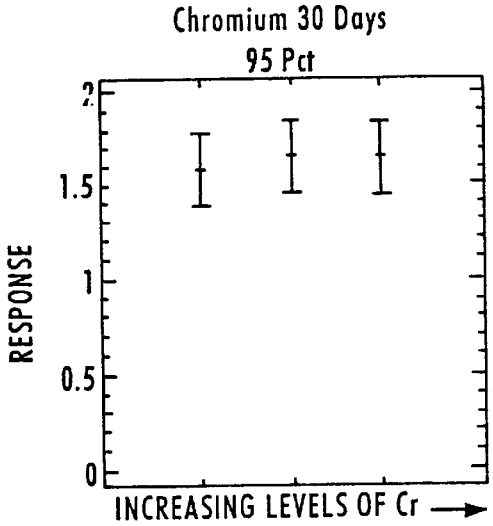
Figure 4C:
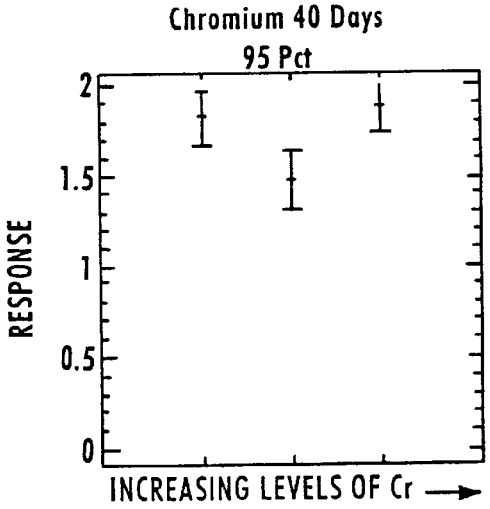

Finally, FIGS. 4*a*–4*c* demonstrate that increasing levels of chromium do not contribute to corrosion resistance. Thus, chromium levels can be maintained at impurity levels for purposes of the inventive alloy, thus reducing-cost without a sacrifice in corrosion resistance.

Although not depicted, similar trends as those depicted in FIGS. 1*a*–4*c* are obtained when comparing the effects of two elements such as copper and zinc or zinc and chromium. In other words, corrosion resistance improves with increasing zinc content and decreasing copper content.

Figure 5:
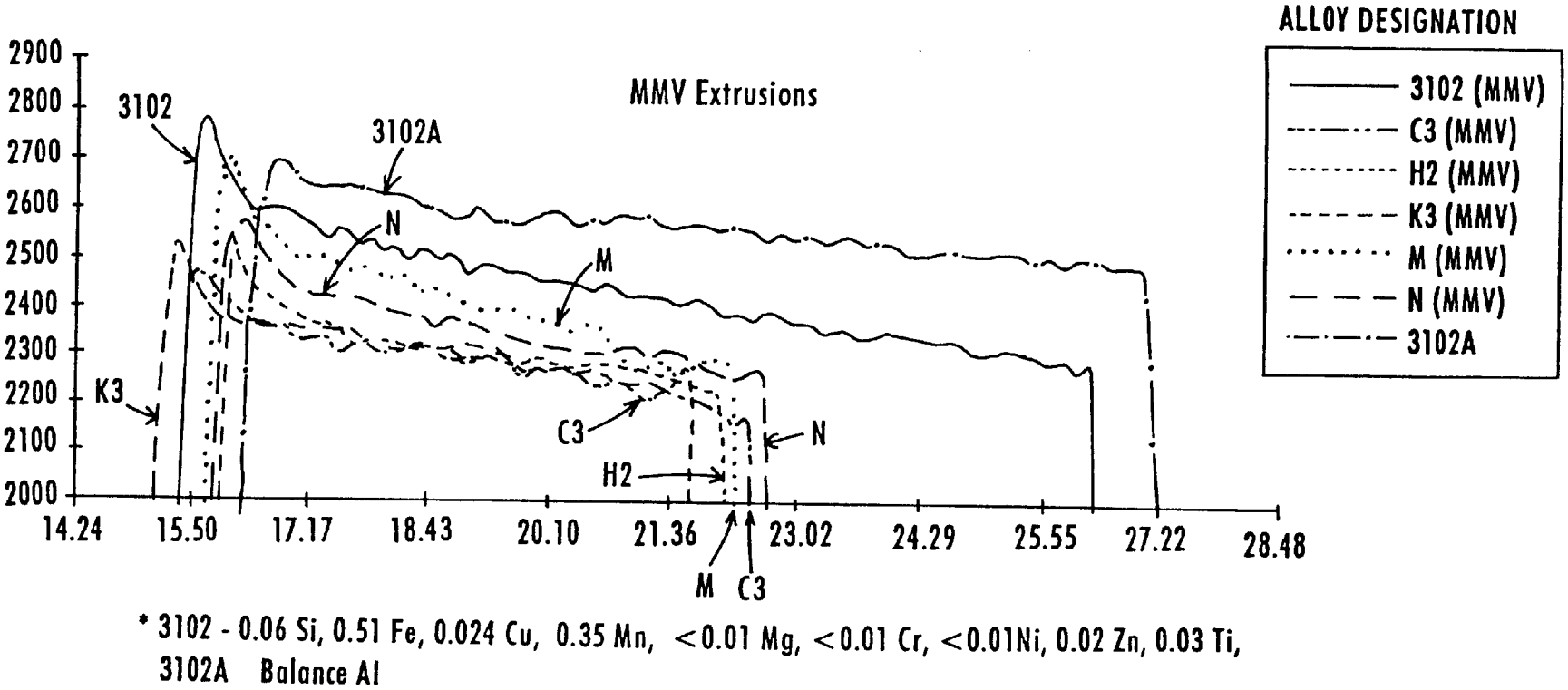
FIG. 5 is a graph comparing extrusion pressures over time for various aluminum alloys.

Quite surprisingly, the increased levels of zinc while improving corrosion resistance do not adversely affect hot formability. Referring now to FIG. 5, a comparison of multivoid extrusions of varying alloying content is shown with respect to extrusion pressure as a function of time. FIG. 5 has a key which identifies the multivoid tubing following the alloying compositions listed in Table 1 with the exception of the 3102 alloys which are listed below the graph. Comparing the curves for alloys C3, M and N, it can be readily seen that the hot formability of the alloys containing the increased levels of zinc, i.e., alloys M and N, is not adversely affected. Consequently, these types of alloys can be successfully extruded while exhibiting improved corrosion resistance over prior art alloys such as AA3102 and that taught in U.S. Pat. No. 5,286,316.

The inventive alloy is believed to be useful in any application which requires good corrosion resistance. The inventive alloy is particularly adapted for use as a condenser tube having either a corrugated or smooth inner surface or as multivoid tubing. In other examples, the composition may be used to produce fin stock for heat exchangers, corrosion resistant foil for packaging applications subjected to corrosion from salt water and other extruded articles or any other article needing corrosion resistance.

As such, an invention has been disclosed in terms of preferred embodiments thereof which fulfill each and every one of the objects of the present invention as set forth hereinabove and provides a new and improved aluminum based alloy composition having improved corrosion resistance and extrudability.

Of course, various changes, modifications and alterations from the teachings of the present invention may be contemplated by those skilled in the art without departing from the intended spirit and scope thereof. It is intended that the present invention only be limited by the terms of the appended claims.

TABLE 1

| ALLOYS | |
|---|---|
| ALLOY DESIGNATION | TARGET WT % |
| A/AA | Cu - <.01 Zn - .03 |
| B/BB | Ti - 0.155, 0.192 |
| C1 | Cu - <.01 Zn - .03 |
| C2 | Ti - 0.06, 0.09, 0.12 |
| C3 | |
| D1 | Cu - 0.01 |
| D2 | Ti - 0.06, 0.09, 0.012 |
| D3 | Zn - 0.03 |
| E1 | Cu - 0.02 |
| E2 | Ti - 0.06, 0.09, 0.12 |
| E3 | Zn - 0.03 |
| F1 | Cr - 0.005, 0.05, 0.10 |
| F2 | Cu - 0.01 |
| F3 | Zn - 0.03 |
| G1 | Cu - .01 |
| G2 | Cr - 0.005, 0.05, 0.10 |
| G3 | Zn - 0.1 |
| H1 | Cr - 0.005, 0.05, 0.10 |
| H2 | Cu - 0.01 |
| H3 | Zn - 0.2 |
| I1 | Cr - 0.005, 0.05, 0.10 |
| I2 | Cu - 0.02 |
| I3 | Zn - 0.03 |
| J1 | Cr - 0.005, 0.05, 0.10 |
| J2 | Cu - 0.02 |
| J3 | Zn - 0.1 |
| K1 | Cr - 0.005, 0.05, 0.10 |
| K2 | Cu - 0.02 |
| K3 | Zn - 0.2 |
| M | 0.1 Fe, <0.01 Cu, 0.26 Mn, <0.01 Mg, 0.1 Cr, <0.01 Ni, 0.2 Zn, 0.12 Ti |
| N | 0.1 Fe, <0.01 Cu, 0.26 Mn, <0.01 Mg, 0.1 Cr, <0.01 Ni, 0.2 Zn, 0.18 Ti |
| L | 0.04 Si, 0.1 Fe, 0.4 Cu, 0.14 Mn, <0.01 Mg, <0.01 Cr, <0.01 Ni, <0.01 Zn, 0.02 V, <0.01 Ga, <0.01 Zr |

TABLE 2

| SWAAT TEST LONG TUBES | | | | |
|---|---|---|---|---|
| | 10 Days | 20 Days | 30 Days | 40 Days |
| A | PP | PP | FF | FF |
| AA | PP | PP | PF | FF |
| B | PP | PP | FF | FF |
| BB | PP | PP | PF | FF |
| C1 | PP | PP | PF | PF |
| C2 | PP | PP | PF | FF |
| C3 | PP | PP | PF | PP |
| D1 | PP | FF | FF | FF |

TABLE 2-continued

| SWAAT TEST LONG TUBES | | | | |
|---|---|---|---|---|
| | 10 Days | 20 Days | 30 Days | 40 Days |
| D2 | PP | PF | FF | FF |
| D3 | PP | PF | FF | FF |
| E1 | PP | FF | FF | FF |
| E2 | PP | FF | FF | FF |
| E3 | PP | FF | FF | FF |
| F1 | PP | PF | FF | FF |
| F2 | PP | PF | FF | FF |
| F3 | PP | FF | FF | FF |
| G1 | PP | PP | FF | PFFF |
| G2 | PP | FF | FF | FF |
| G3 | PP | PP | FF | FF |
| H1 | PP | PF | PF | PF |
| H2 | PP | PP | PP | PF |
| H3 | PP | PP | FF | FF |
| I1 | PP | FF | FF | FF |
| I2 | PP | FF | FF | FF |
| I3 | PP | FF | FF | FF |
| J1 | PP | PP | | |
| J2 | PP | FF | FF | FF |
| J3 | PP | FF | FF | FF |
| K1 | PP | PF | FF | FF |
| K2 | PP | FF | FF | FF |
| K3 | PP | FF | FF | FF |
| L | PP | FF | FF | FF |
| M | PP | PP | PP | PP |
| N | PP | PP | PP | PP |
| 3102 | PP | F × 4 | F × 4 | F × 4 |

TABLE 3

| SWAAT TEST SHORT TUBES | | | | |
|---|---|---|---|---|
| | 10 Days | 20 Days | 30 Days | 40 Days |
| A | PP | PP | PF | FF |
| AA | PP | PP | PP | FF |
| B | PP | PP | PF | FF |
| BB | PP | PP | PF | FF |
| C1 | PP | PP | PP | PF |
| C2 | PP | PP | PF | PP |
| C3 | PP | PP | PP | PF |
| D1 | PP | PF | FF | FF |
| D2 | PP | PF | FF | FF |
| D3 | PP | PP | FF | FF |
| E1 | PP | FF | FF | FF |
| E2 | PF | FF | FF | FF |
| E3 | PP | FF | FF | FF |
| F1 | PP | PF | PF | FF |
| F2 | PP | PP | FF | PF |
| F3 | PP | PF | PF | FF |
| G1 | PP | PP | PP | PFFF |
| G2 | PP | PF | FF | PF |
| G3 | PP | PF | PF | FF |
| H1 | PP | PP | PF | FF |
| H2 | PP | PP | PP | PP |
| H3 | PP | PP | PP | PF |
| I1 | PP | FF | FF | FF |
| I2 | PP | FF | FF | FF |
| I3 | FF | FF | FF | FF |
| J1 | PP | FF | | |
| J2 | PP | PP | FF | FF |
| J3 | PP | PF | FF | FF |
| K1 | PP | PP | FF | PF |
| K2 | PP | FF | FF | PF |
| K3 | PP | PF | FF | FF |
| L | FF | FF | FF | FF |
| M | PP | PP | PP | PP |
| N | PP | PP | PP | PP |
| 3102 | F × 4 | F × 4 | F × 4 | F × 4 |

What is claimed is:

1. A corrosion resistant aluminum alloy consisting essentially of in weight percent:

a) an amount of copper up to 0.03%, b) between about 0.05 and 0.12% silicon;

c) between about 0.1 and 0.5% manganese;

d) between about 0.03 and 0.30% titanium;

e) between about 0.1 and 1.0% zinc;

f) less than 0.01% magnesium;

g) an amount of iron up to 0.50%;

h) less than 0.01% nickel; and i) up to 0.5% chromium with the balance aluminum and incidental impurities, said alloy having improved corrosion resistance such that a 6 mm diameter extruded tube formed from said alloy and having a wall thickness of 0.41 mm resists corrosion penetration of the tube wall for at least 20 days when subjected to a SWAAT test in accordance with ASTM G85 standards.

2. The alloy of claim 1 wherein the copper is less than about 0.01%.

3. The alloy of claim 1 wherein titanium is between about 0.07 and 0.20%.

4. The alloy of claim 1 wherein iron is between about 0.05 and 0.30.

5. The alloy of claim 1 wherein copper is less than about 0.01%, titanium is between about 0.07 and 0.20% and iron is between about 0.05 and 0.30%.

6. The alloy of claim 1 wherein chromium is present in amount up to 0.2%.

7. A foil having the composition of claim 1.

8. The alloy of claim 1, wherein the improved corrosion resistance is such that the tubing resists corrosion penetration of the tube wall for at least 30 days.

9.The alloy of claim 1, wherein the improved corrosion resistance is such that the tubing resists corrosion penetration of the tube wall for at least 40 days.

* * * * *